US005839607A

United States Patent [19]

Swanson

[11] Patent Number: 5,839,607

[45] Date of Patent: Nov. 24, 1998

[54] GOLF BALL STORING AND DISPENSING DEVICE

[76] Inventor: Scott D. Swanson, 8466 N. Lockwood Ridge Rd., Suite 210, Sarasota, Fla. 34243

[21] Appl. No.: 862,894

[22] Filed: May 23, 1997

Related U.S. Application Data

[60] Provisional application No. 60/018,245, May 24, 1996.

[51] Int. Cl. [6] ..... B65H 1/08

[52] U.S. Cl. ..... 221/231; 221/185

[58] Field of Search ..... 221/226, 232, 221/231, 185, 303, 307, 308, 310, 277

[56] References Cited

U.S. PATENT DOCUMENTS 2,950,748 8/1960 Olinghouse .
3,412,897 11/1968 Slater .
4,610,373 9/1986 Sherbondy .
5,191,995 3/1993 McDonald .

*Primary Examiner*—Kenneth Noland
*Attorney, Agent, or Firm*—Jack N. Kraszewski

[57] ABSTRACT

A golf ball dispensing device for use in storing and dispensing of golf balls is constructed of a tube which has an upper portion and a base at the bottom. A stack of golfs balls are maintained in the tube under spring bias between a piston which urges the balls upwardly and a ball trap member which retains the top golf ball from dispensing through a nozzle. A cap is attached to the upper portion of the tube and houses a ball ejector assembly which is pivotally connected to the ball trap member below. To disperse a golf ball, a push button is depressed activating the ball ejector assembly which pivots the ball trap member to release the top golf. Simultaneously as the ball trap member releases the top golf ball, a lever pivotally connected to the ball trap member, urges the top golf ball through the nozzle. Upon release of the push button, the spring biased piston urges the next golf ball upwardly into the ball trap member.

13 Claims, 3 Drawing Sheets

GOLF BALL STORING AND DISPENSING DEVICE

CROSS REFERENCE TO RELATED APPLICATIONS

This application claims the benefit of U.S. Provisional Application No. 60/018,245, filed May 24, 1996.

FIELD OF THE INVENTION

The present invention relates generally to an accessory for use during the game of golf. More particularly, it relates to a device for storing and retaining golf balls in a stacked arrangement. The present invention also relates to a device for facilitating the dispensing and reloading of the golf balls in a stacked arrangement.

BACKGROUND OF THE INVENTION

Golf ball dispensers are known in the art. Indeed, there have been a number of different devices patented for dispensing individual golf balls from some form of a tubular housing. Attempts have been made to develop spring-loaded devices for dispensing golf balls. Often the devices require a golfer to manipulate the ball from a restricted opening. Ultimately, these attempts suffer from difficulty in operability due to the multiple steps required to dispense the ball.

Examples of golf ball dispensers are shown in U.S. Pat. No. 4,610,373 to Sherbondy, which discloses a spring biased tubular golf ball dispenser having multiple apertures for maneuvering a golf ball with one's finger into dispensing register. As typical golfers have little patience, particularly during a bad round, the inconvenience of poking around for a golf ball only adds to a golfer's frustration. Accordingly it is desirable to provide a golf ball dispenser which facilitates the dispersal of a ball with a one-step push button activated dispenser.

U.S. Pat. No. 5,191,995 to McDonald discloses a spring biased system for delivering balls to the dispensing opening. The McDonald patent discloses a dispensing head having a spring biased piston head which must be extended and then telescoped through a sleeve across the ball holding tube to carry a golf ball to dispersal. The McDonald patent requires the user to manipulate a spring loaded piston head from a set position to a cocked position to an extended position in order to carry a golf ball for dispersal. In addition, as the piston is pulled back, before passing through the sleeve, the spring wrapped around the piston is outside the body of the sleeve and may become entangled with the golfer's bag or other loose items.

Other golf ball dispensers are known for example U.S. Pat. No. 3,412,897 to Slater and U.S. Pat. No. 2,950,748 to Olinghouse, both of which employ a spring-loaded cylinder for delivering a golf ball to the dispensing opening and some form of barrier for maintaining the ball in the cylinder which is retractable or removable for dispensing the ball.

None of the known prior art devices provide a one step push button dispensing device wherein balls are firmly held in position until dispensed and may easily be loaded into the dispensing device.

SUMMARY OF THE PRESENT INVENTION

The present invention provides a novel golf ball storing and dispensing device. The golf ball storing and dispensing device includes a tubular member having a housing portion with a cap attached to the top thereof. Within the tubular member is positioned a coil spring to upwardly bias a number of golf balls stacked in the tubular member. The top most golf ball of the stack of balls is partially retained in the housing portion of the device by a ball trap member. The ball trap member releases the top golf ball upon activation of a pivotally connected ball ejector assembly by a golfer when a golf ball is desired to be used. The ball ejector assembly is manually activated by pressing a push button which activates the ejector assembly to pivotally rotate the pivotally connected ball trap member such that the member releases the retained top golf ball. A lever, also pivotally connected to the ball trap member, urges the now released top golf ball through a nozzle opening in the housing portion to the golfer.

Upon dispersal of the last golf ball, the golf ball storing and dispensing device may be readily reloaded. The device provides a ball reloading assembly to facilitate the reloading of the device by a golfer. One embodiment of the invention provides a stud attached to a piston engaged with the coil spring that urges the golf balls upwardly. The stud extends through a longitudinal slot in the tubular member and can be depressed and retained in the bottom of the slot to hold the coil spring and piston in compression while the golf balls are loaded.

Another embodiment of the ball reloading assembly includes a cord attached at one end to a pull ring and at the other end to a top portion of the coil spring. The cord is provided for retracting and compressing the coil spring in the tubular member by pulling the cord through a base portion of the tubular member and releasably retaining the cord with the base portion to provide an empty tubular member to allow a golfer to easily load the golf balls through the nozzle opening and into the tubular member. After reloading, the cord is released so that the coil spring again provides an upward pressure on the stack of golf balls. The cord is fed back into the tubular member and the pull ring is snap fit back into the base portion of the tube.

The golf ball storing and dispensing device can be attached inside or outside a golfer's bag. The device can be formed of a plastic or other resilient material and can be of various colors.

BRIEF DESCRIPTION OF THE DRAWINGS

These and other features and advantages of the present device will become more fully apparent from the following description in which the device is described in detail in conjunction with the accompanying drawings which form a part of the specification.

DETAILED DESCRIPTION OF THE INVENTION

Figure 1:
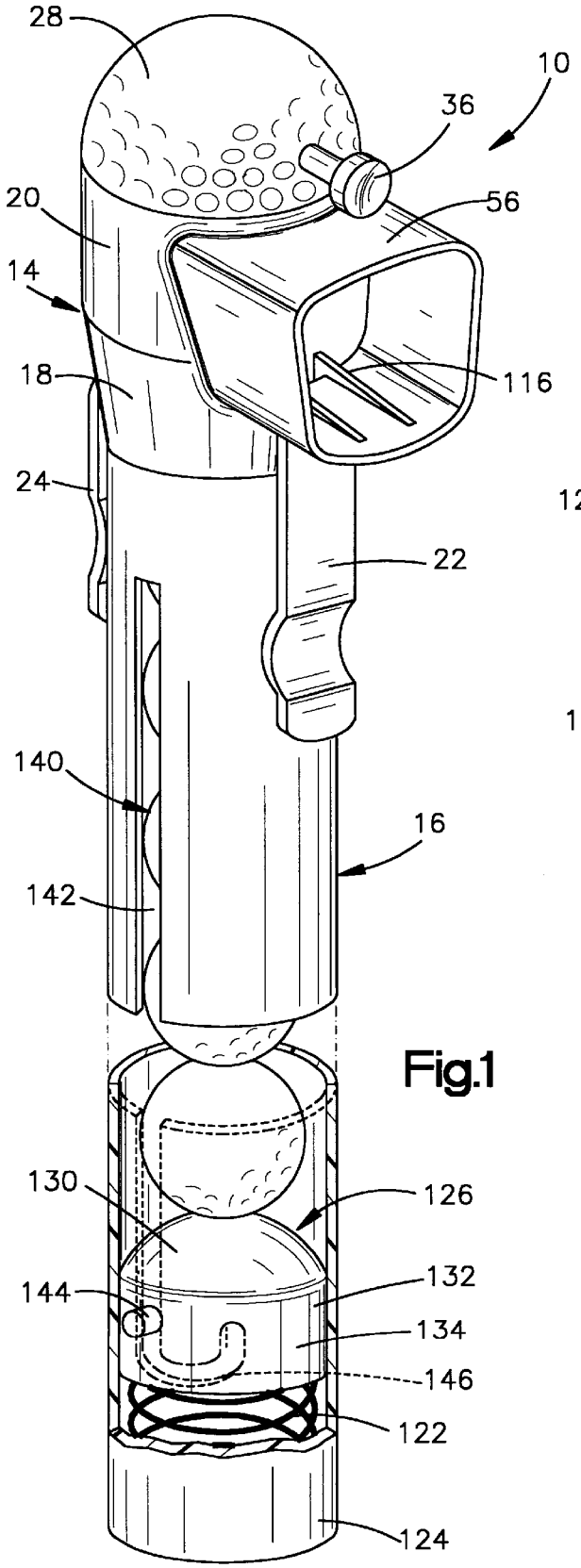
FIG. 1, is a fragmentary perspective view of one embodiment of the golf ball storing and dispensing device showing a section removed to expose the coil spring and piston urging the stack of golf balls upward.

A golf ball dispensing device 10 is provided as shown in FIG. 1 for use by golfers to facilitate the retaining and dispensing of golf balls. It should be understood that any conventional golf ball 12 may be utilized in conjunction with the present invention. The preferred embodiment of the present invention includes tubular member 16 having an upper portion 14. The tube 16 and upper portion 14 have a length sufficient to hold from 6 to 20 golf balls, preferably from 10 to 15 golf balls, vertically aligned therein. The upper portion 14 and tube 16 are preferably molded from any conventional plastic, but can also be made of aluminum or other material providing a light weight with sufficient toughness. The tube 16 has an inner diameter slightly larger than the diameter of a golf ball for retaining golf balls in a vertical arrangement. The upper portion 14 has a lower portion 18 of tapered cylindrical configuration having a bottom periphery with substantially the same diameter as the tube 16 and a housing portion 20 having a diameter substantially the same as the diameter of the top periphery of the lower portion 18. A pair of opposing flanges (not shown) extend from the internal sides of the upper portion 14 to align the golf balls as they enter the upper portion from the tube.

Upper portion 14 also has at least one and preferably two clips 22, 24 attached thereto and extending downwardly therefrom. The clips 22, 24 are preferably located at opposite sides of the device and are used to attach the device to the top of a golf bag (not shown). The clips allow the user to fasten the device inside or outside of the user's golf bag by using either the front clip 22 or rear clip 24, respectively.

Figure 4:
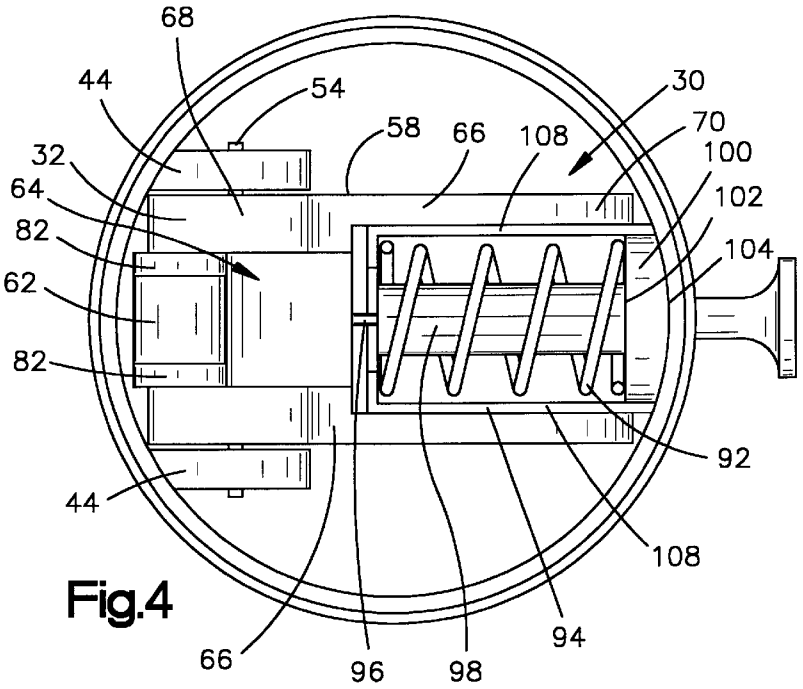
FIG. 4, is a bottom view of the cap showing the ball trap member and ball ejector assembly of FIG. 3 without a retained golf ball.
Figure 3:
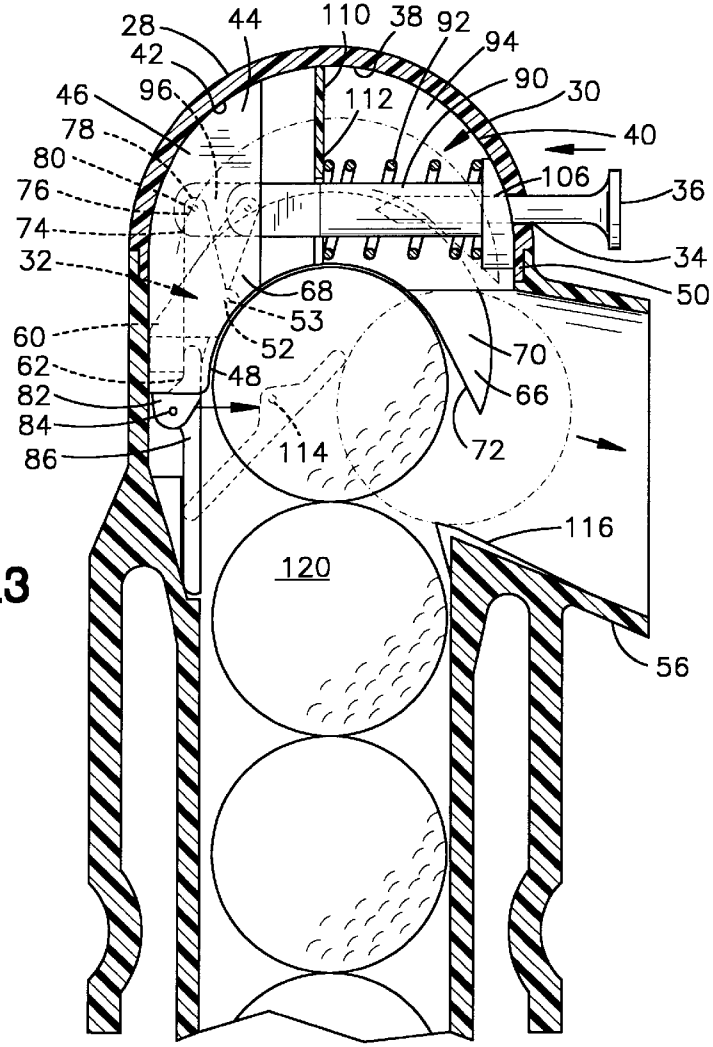
FIG. 3, is a fragmentary cross-sectional view of the golf ball storing and dispensing device taken along the line 3—3 of FIG. 2, and showing the ball trap member and ball ejector assembly in a set position retaining the top golf ball, and schematically showing the assemblies in an extended position releasing and dispersing the top golf ball.

A cap 28 of spherical configuration is attached to the top of upper portion 14. The cap 28 houses a ball ejector assembly 30 and partially houses a ball trap member 32 for dispensing a golf ball 12, as seen in FIG. 3. The cap 28 is fixedly attached to the housing portion 20 preferably by a step fit and by any conventional means such as an adhesive or cement. The cap 28 also has an aperture 34 through which the push button 36 of the ball ejector assembly 30 is positioned, as will be herein further described. The cap 28 has an interior surface 38 having a front side 40 and a rear side 42. The interior surface of the cap 28 supports two opposing support arms 44 each comprised of a planar member having an upper portion 46 and a lower portion 48. The upper portion 46 of each arm is positioned perpendicularly against the rear side 42 of the cap interior 38 and extend downwardly from the top of the cap interior. The lower portion 48 of each arm 44 extends beyond the cap periphery 50 and into the housing portion 20. Each arm has an aperture 52 aligned with the aperture of the other arm for retaining a pin 54 therethrough, as can be seen in FIG. 4.

The function of the support arms 44 is two-fold in that the arms partially retain the top golf ball 12 and pivotally connect the ball trap member 32. The lower portion 48 of each arm is configured so as to partially retain the top golf ball, as will be herein further described. To pivotally connect the ball trap member 32, the opposing arms 44 are positioned a distance apart allowing for the positioning of the ball trap member 32 between the arms 44. The ball trap member 32 is pivotally connected between the opposing arms by the pin 54 which is positioned through the aligned apertures of arms 44 and ball trap member 32, as will be herein further described.

Figure 2:
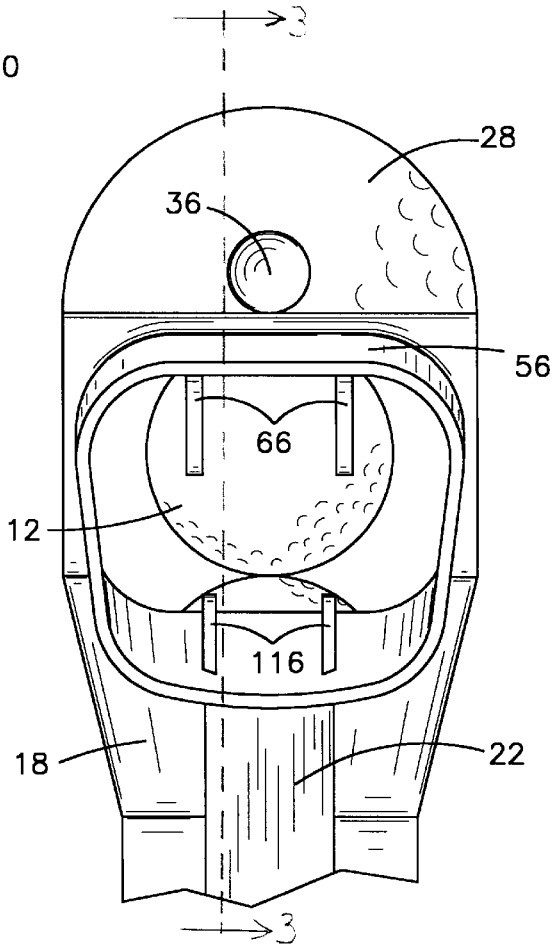
FIG. 2, is a fragmentary front view of a top portion of the device of FIG. 1, showing the nozzle opening and a top golf ball retained within the device.

As seen in FIGS. 1, 2 and 3, golf balls are stacked in the upper portion 14 and tube 16. Top golf ball 12 is substantially aligned with a dispensing nozzle 56 and partially protrudes into the ball trap member 32 such that the ball is retained by the member. The ball trap member 32 has an outer portion 58, an inner portion 60, a lower portion 62 and a central portion 64. The outer portion 58 is comprised of opposing handles 66 having a first end 68, a second end 70, and a bottom surface 72. The first end of each handle 66 has aperture 53 therethrough which is aligned with the aperture of the other handle, as will be further described herein. The opposing handles 66 extend in curvature from first end 68 to the second end 70. The curved shape of the handles 66 allows the bottom surface 72 of each handle to partially surround the uppermost golf ball 12, thus retaining the ball and preventing its unwanted dispersal. The handles 66 are spaced apart from one another to retain a greater surface area of the ball and to allow for the positioning of the inner 60, lower 62 and central 64 portions therebetween.

The inner portion 60 of the ball retaining member is comprised of opposing flanges 74 having a top end 76. The flanges 74 are positioned between the handles 66 and extend upwardly from the central portion 64 beyond the handles. The top end of each flange has an aperture 78 therethrough aligned with the aperture of the opposing flange. The flanges 74 extend upwardly from the central portion 64 and beyond the handles 66 such that the apertures 78 of each flange align with the apertures 80 of the ball ejector assembly 30 to pivotally connect the ball ejector assembly and the ball trap member 32, as will be herein further described.

The lower portion 62 of the ball trap member 32 extends downwardly from the central portion 64. The lower portion is comprised of opposing flanges 82 having aligned apertures 84 therethrough. The opposing flanges are spaced a distance apart to allow for pivotally connecting a ball urging lever 86 therebetween, as will be herein further described.

The central portion 64 of the ball trap member 32 also has aperture 53 continuing therethrough and aligned with the apertures 52 of support arms 44. As previously described, the central portion 64 is positioned between and contiguous the handles 66 and aperture 53 extends through the central portion 64 and handles 66. The inner 60, lower 62 and central portion 64 as well as the first end 68 of the handles 66 are positioned between the support arms 44. As such, the ball trap member 32 is positioned between the support arms 44.

As previously discussed, the ball trap member 32 is pivotally connected to the support arms 44. To pivotally connect the ball trap member 32 to the arms 44, the member 32 is positioned between the arms 44 such that the aperture 53 of the central portion 64 and handles 66 is aligned with the apertures 52 of the arms. Pin 54 is positioned through the aligned apertures providing for the pivot connection of the ball trap member 32 to the arms 44. The pivot connection allows, in part, the ball trap member 32 to disperse the retained golf ball 12 through the dispensing nozzle 56 upon activation of the ball ejector assembly 30, as will be herein further described.

The ball ejector assembly 30 is provided to activate the ball trap member 32 so as to disperse a golf ball 12 from the golf ball storing and dispensing device 10. As seen in FIGS. 3 & 4, the ball ejector assembly 30 includes a push rod 90, a push button 36, a resilient coil spring 92, and a guide shield 94. The push rod 90 has a front end 96, a central portion 98 and a base end 100 having a diameter larger than the diameter of the central portion 98 and having a cap side 102 and a spring side 104. The base end 100 also has an aperture 106 aligned with the aperture 34 of the cap which extends through the push rod 90 to house a portion of the push button 36. The front end 96 of the push rod 90 is substantially planar and has aperture 80 therethrough, as will be herein further described. The central portion 98 of the push rod between the base end 100 and the front end 96 is positioned within the spring 92. The spring side 102 of the base end supports one end of the spring and the guide shield 94 supports the other spring end, as will be herein further described.

The push rod 90 is positioned inside the cap 28 between the front side 40 of the cap interior and the top ends 76 of the flanges 74 of the ball trap member 32. The push button 36, preferably shaped like a golf tee, is retractably positioned through the aperture 34 of the cap 28 above the dispenser nozzle 56. As previously described, the push rod 90 preferably has an aperture 106 aligned with the cap aperture 34 for retaining and housing the portion of the push button 36 which extends into the interior of the cap 28.

As seen in FIGS. 3 & 4, the ball ejector assembly also includes a guide shield 94 which houses the spring 92 and portions of push rod 90. The guide shield 94 also provides a base for the coil spring 92. The guide shield 94 is comprised of opposing walls 108 connected at a first end by a perpendicular cut away wall 110 having a bottom portion 112 which provides a base for the coil spring 92. The bottom portion 112 has an open area configured to allow the front end 96 of the push rod 90 to pass therethrough, but sufficiently narrow to provide a base for the coil spring 92. The guide shield 94 is fixedly attached to the interior surface 38 of the cap 28 along the peripheries of the guide walls 108, except for the bottom portion of the guide wall periphery, by any conventional means such as adhesives, cement or molding.

As previously described, the ball ejector assembly 30 is pivotally connected to the ball trap member 32. The front end 96 of the push rod 90 is planar and has a width less than the distance between the flanges 74 of the ball trap member. The first end 96 of the push rod is positioned between the flanges 74 and the apertures 78, 80 of flanges 74 and the first end 96, respectively, are aligned and a pin (not shown) positioned therethrough to provide a pivot connection.

The golf ball storing and dispensing device 10 is activated by manually pressing or pushing the push button 36. The depression of the push button in turn moves the push rod 90 laterally from a set position to an extended position, as seen in FIG. 3. As the push rod 90 is displaced, the coil spring 92 is compressed between the bottom portion 112 of the guide shield 94 and the base end 100 of the push rod thus biasing the rod 90 and button 36 to return to the set position upon release of the push button 36. The displacement of push rod 90 extends the rod and the front end 96 causing the pivotally connected flanges 74 of the ball trap member 32 to move from a set position to an extended position. Substantially simultaneously, the ball trap member 32 rotates about the pivot connection of the central portion 64, the support arms 44 and the first end 68 of the handles 66 about pin 54 counterclockwise and towards the nozzle side of the device, as depicted from the perspective in FIG. 3. Thus, resulting in the lifting or raising of the handles 66 to release the top golf ball 12.

To disperse the released top golf ball 12 through the nozzle 56, urging lever 86 is pivotally connected to the ball trap member 32. The lever 86 is pivotally connected to the lower portion 62 of ball trap member 32. Lever 86 has an upper end with an aperture 114 therethrough. The upper end of the lever 86 is aligned adjacent the top golf ball 12 when the ball trap member 32 is in the retaining set position. Lever 86 is pivotally connected to the ball trap member 32 by aligning aperture 114 with the apertures 84 of flanges 82 and inserting a pin (not shown) through the aperture alignment to form a pivot connection. Lever 86 also has a lower end which is aligned with the golf ball 120 directly below top golf ball 12. Thus, as the ball trap member 32 is displaced by initiation of the ejector assembly 30, the lower portion 62 moves toward the golf ball 12. The movement of the lower portion causes the lever 86 to pivot about the pivot connection with flanges 82 in turn causing the upper end of the lever 86 to urge golf ball 12 through the nozzle 56 as the lower end of the lever 86 exerts downward pressure on the next golf ball 120 to prevent it from prematurely entering the ball trap member 32.

Thus, to disperse the ball 12 through the nozzle 56, the push button 36 of the ball ejector 30 is depressed causing the push rod 90 to move substantially laterally. As the push rod 90 is moving, the base end 100 of the push rod is compressing the coil spring 92 against the cut away wall 112 of the guide shield 94 to bias the push rod. The lateral movement of the front end 96 of the push rod displaces the ball trap member 32 from a set, retaining position to an extended position as the flanges 74 of the inner portion 60 rotate about the pivot connection with the first end 96. Substantially simultaneously, central portion 64 and first ends 68 of handles 66 pivot about the axis of pin 54, created by the pivot connection with the arms 44, thus causing the handles 66 to lift upwardly from the top golf ball 12. Upon the ball trap member 32 reaching the extended position, the top golf ball 12 is released by the handles 66 as the handles have been raised. Correspondingly, the displacement of the ball trap member 32 causes lower portion 62 to substantially simultaneously displace from a set position towards the golf ball 12 to a secondary position. The movement of lower portion 62 causes the lever 86 to pivot about the pivot connection of the flanges 82 and lever, in turn causing the upper end of the lever to urge the top golf ball 12 freely through the nozzle 56 as the handles 66 are in the raised position.

To facilitate ball dispersal, a pair of guides 116 extend from the tube interior along a portion of the interior bottom surface of the nozzle 56. The guides 116 provide a path for golf ball 12 during dispersal so that the ball will exit the nozzle 56 and land in the user's hand in a consistent direction. The guides 116 also assist in directing the next golf ball 120 away from the nozzle opening as the ball is being urged upwardly to replace the recently dispersed top golf ball 12.

The ball trap member 32 and ball ejector assembly 30 are returned to their respective set positions, preferably after dispersal of golf ball 12, upon release of the push button 36 by the user. The biased push rod 90 is urged to return to the set position by the compressed coil spring 92. As the user releases the push button 36, the push rod 90 returns to the set position in turn causing the ball trap member 32 to return to its set position by the reverse movements and rotations of the ball trap member 32, ball ejector assembly 30 and lever 86 around the previously described respective pivot connections.

Upon dispensing of the top golf ball 12, golf ball 120 is automatically loaded into the retained, set position upon release of the push button 36. Golf ball 120 is urged upwardly into the handles 66 of the ball trap member 32 as the ball ejector assembly 30 and ball trap member return to the set position. A resilient coil spring 122 extends upwardly from the base 124 of the tube 16 to a piston 126 in the tube, as can be seen in FIG. 1. Base 124 includes an internal surface (not shown) which provides a support for the bottom of coil spring 122, as will be herein further described. Further upward travel of the spring 122 and piston 126 is halted by the retention of the ball 120, now top golf ball 12, by the ball trap member 32 and arms 44, as can be seen in FIG. 3. When the golf balls are stacked inside tube 14, piston 126 and spring 122 normally exert upward pressure on the stack of balls.

In one embodiment, the piston 126 is substantially hollow and has a top portion 130, central ring portion 132 and a bottom portion 134. The top portion 130 is preferably rounded to facilitate upward pressure on the ball, but can be of any configuration which allows for the exertion of upward pressure on the golf ball such as a flat surface. The top portion 130 also includes an aperture or indentation in the top end to provide a seat in which the golf ball can rest. The bottom portion 134 is cylindrical in shape and has an external diameter slightly smaller than the internal diameter of the tube. The bottom portion 134 has an internal diameter slightly larger than the diameter of the coil spring 122 such that the top of the coil spring fits within the lower portion. The spring 122 is retained within the piston 126 by positioning the end of the spring in an aperture within the piston, or by any conventional means known in the art such as forming a platform within the piston against which the top of the spring can push against. The bottom portion 134 is thus the base for the top of the spring 122. The external diameter of the bottom portion 134 is also slightly smaller than the internal diameter of the tube 16 thus providing for an upward and downward spring biased and channelled movement of the piston 126.

Figure 5:
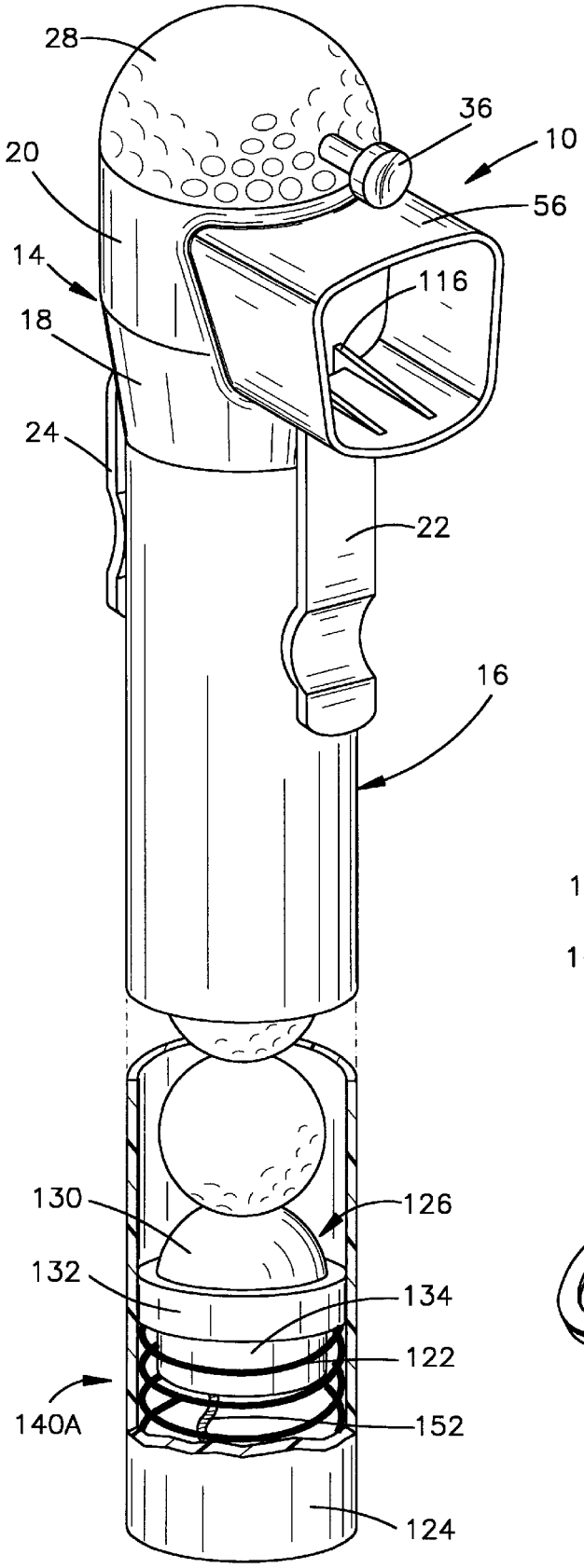
FIG. 5, is a fragmentary perspective view of another embodiment of the golf ball storing and dispensing device showing a section removed to expose the coil spring and piston urging the stack of golf balls upward.

In another embodiment, the piston 126 has a top portion 130, central ring portion 132 and a bottom portion 134, as seen in FIG. 5. The top portion 130 is preferably rounded to facilitate upward pressure on the ball 140, but can be of any configuration which allows for the exertion of upward pressure on the golf ball such as a flat plate. The bottom portion 134 has an external diameter slightly smaller than the diameter of the coil spring 122 allowing the top of the coil spring to wrap around the bottom portion. The central ring portion 132 of the piston 126 has an external diameter slightly larger than the diameter of the coil spring 122 and provides a top base against which the coil spring rests. The external diameter of the central ring is slightly smaller than the internal diameter of tube 16 thus providing for an upward and downward spring biased and channelled movement of the piston.

In the preferred embodiment of the invention, the device 10 also provides a ball reloading assembly 140 allowing for the manual replacement of golf balls in the tube 16, as can be seen in FIG. 1. A longitudinal channel 142 is formed in the side of the tube 16. The channel 142 extends substantially the same length as the distance between the ball trap member and the lower portion of the piston 126 in the compressed position, as will be herein further described. A stud 144 extends from the piston 126, preferably the bottom portion 134, and is positioned in the channel 142. The stud 144 protrudes through the channel 142 such that one may handle the stud 144 with finger operation. The bottom end of channel 142 has a bend 146 for retaining the stud 144. The bend 146 is preferably of an upwardly curved configuration, but may also be shaped as a right angle. To compress the coil spring 122 and clear the tube 16 for loading with golf balls, the stud 144 is urged downwardly into the bend 146 where the upward force retains the stud in the bend providing for the compression of the spring 122 and piston 126.

To load new golf balls into the device 10, the handles 66 of the ball trap member 32 must be raised to clear the opening of nozzle 56. The nozzle opening is cleared by depressing the push button 36 of the ball ejector assembly 30 to raise the handles 66 of the ball trap member 32, as previously described above. As the user maintains depression of the push button 36, golf balls may be easily loaded into the nozzle and down the cleared tube. The first loaded golf ball will rest against the top portion 130 of piston 126 and subsequent golf balls will be stacked until the top golf ball 12 can be seen through the nozzle opening. The portion of guides 116 extending from the tube interior prevent top golf ball 12 from unwantingly exiting the nozzle 56 by directing the ball away from the nozzle opening. When the top golf ball 12 is in position, the push button 36 is released and the handles 66 lowered to retain the top golf ball in the set position. The stud 144 is then slid from the bend 146 releasing the coil spring 122 to urge the stack of golf balls upwardly.

Figure 6:
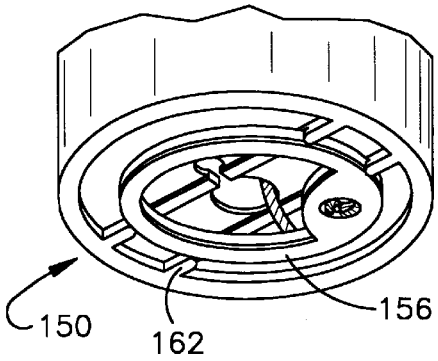
FIG. 6, is a fragmentary bottom view of a base portion of the device in FIG. 5, showing the pull ring snap fit into the base portion.
Figure 7:
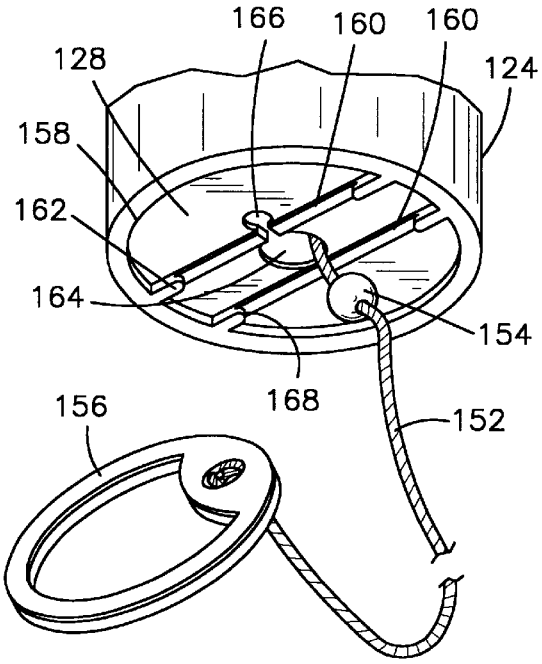
FIG. 7, is a fragmentary bottom view of the base portion of the device in FIG. 6, but showing the cord and pull ring removed from the base portion for operation.

In another embodiment of the invention, the device 10 provides a ball reloading assembly **140*a* allowing for the manual replacement of golf balls in the plastic tube, as can be seen in FIGS. 6 & 7. The ball reloading assembly 140*a* includes a resilient cord 152, a bead 154 affixed to the cord, a pull ring 156 and the tube base 124. The cord 152 is affixed to and between the bottom of piston 126 and pull ring 156. Bead 154 is affixed to the cord 152 remotely from the top of the cord, as will be herein further described. The base 124 of tube 16 has an external bottom surface 128, a lip 158, raised ribs 160 extending from the external surface 128, at least two and preferably four dimples 162 extending from the lip 158, and an aperture 164 therethrough. The geometric configuration of the aperture 164 is such that a central opening is provided in the bottom surface 128 allowing the cord 152 and bead 154 to pass therethrough. The geometric configuration of the aperture further includes two smaller openings 166, adjacent and contiguous the larger, central opening. The aperture 164 permits the cord 152 and bead 154 to be pulled through the central opening and for the maneuvering of the cord into one of the smaller openings 166 wherein the bead will rest against the bottom surface 128 and raised rib 160, as seen in FIG. 7**.

When the golf ball dispensing device 10 is loaded and in operating assembly, the ring 156 is removably secured within the base 124 of the tube 16, as seen in FIG. 6. The ring 156 has an external diameter slightly larger than the internal diameter of the lip 158 measured from the dimples 162. Dimples 162 include deflecting tips 168 to provide a snap fit of the ring 156 within lip 158 and base 124. When in loaded assembly, the cord 152 and bead 154 are stored in the tube 16.

Upon use of the last golf ball in the golf ball dispensing device 10, the device will need to be reloaded with golf balls. To reload the device 10, the coil spring 122 and piston 126 may be compressed to accommodate new golf balls. As seen in FIGS. 6 and 7, the golfer will snap the pull ring 156 from the lip 158 of base 124. As seen in FIG. 7, the ring 156 would then be pulled such that the bead 154 and cord 152 are drawn through aperture 164 in the base. As cord 152 is being pulled through the aperture 164, piston 126 is pulled towards base 124 in turn causing coil spring 122 to compress against the internal surface of the base and the central ring 132 of the piston, or in another embodiment against the internal surface of the piston when the spring is retained within the lower portion of the piston. Upon protrusion of the bead 154 through the aperture 164, the piston 126 has been compressed within tube 14 to facilitate the entry of golf balls into the tube 14.

To retain the piston 126 in compression, the bead 154 and portion of the cord 152 above the bead are maneuvered by the user into the smaller opening 166 of the aperture such that the bead is positioned against the corresponding raised rib 160. As the slack in the cord 152 is released, the portion of the cord between the piston 126 and the bead 154 becomes taught as bead 154 is retained by raised ribs 160 of the external base surface 128. The balls may now be loaded into the device 10.

To load new golf balls into the device 10, the handles 66 of the ball trap member 32 must be raised to clear the opening of nozzle 56, as previously described above. Upon loading of the golf balls and positioning of the ball trap member, the pull ring 156 is then maneuvered to release the bead 154 from the raised rib 160 as the piston 126 is now biased between the stack of golf balls and internal base surface. The bead 154 and cord 152 are positioned back through the aperture 164 into the tube 14. Upon threading the cord and bead into the tube, the pull ring 156 is snap fit into the base lip 158 for storage until a subsequent reloading is required, as can be seen in FIG. 6. When fully loaded, the golf ball dispensing device 12 can contain preferably from 10 to 15 golf balls, more preferably up to 12 golf balls.

It will be appreciated that the inventive golf ball storing and dispensing device enables one to store a plurality of golf balls in a device and allows one to easily access one golf ball by pushing a button. This considerably reduces the time and effort one endures in bending over and searching for a golf ball in one's golf bag.

The invention has been described with reference to preferred embodiments. Obviously, modifications and alterations will occur to others upon reading and understanding the preceding detailed specification. It is intended that the invention be construed as including all such alterations and modifications insofar as they come within the scope of the appended claims or the equivalents thereof.

What is claimed is:

1. A golf ball dispensing device for use in storing and dispensing of golf balls comprising:

a tubular member for storing a plurality of golf balls in a stacked configuration having an upper portion at one end of said tubular member and a base at the other end of said tubular member;

a cap, having a periphery, an interior surface and an exterior surface, is fixedly attached along said periphery to said upper portion of said tubular member, said cap having opposing support arms extending downwardly from said interior surface into said upper portion, said cap having an aperture therethrough;

a ball trap member for retaining the top golf ball of the plurality of stacked golf balls, said ball trap member housed within said cap and said upper portion and positioned between and pivotally connected at a pivot connection to said opposing support arms;

a ball ejector assembly secured to said cap interior and pivotally connected to said ball trap member, said ball ejector assembly movable from a set position wherein said ball trap member retains a golf ball, to an extended position wherein said ball trap member rotates about said pivot connection to release the golf ball;

a nozzle opening formed in said upper portion of said tubular member and positioned below a push button and substantially aligned with the golf ball retained by said ball trap member;

a lever pivotally connected to said ball trap member for urging the top golf ball through said nozzle opening substantially simultaneously when said ball trap member releases the top golf ball;

a spring biased piston for urging a stacked plurality of golf balls against said ball trap member such that the dispersed top golf ball is replaced.

2. A golf ball dispensing device for use in storing and dispensing golf balls as described in claim 1 wherein said ball ejector assembly comprises:

a push rod having a front end shaped substantially planar, a central portion, and a base end;

said push button positioned through said aperture of said cap and secured to said push rod, a guide shield having opposing walls connected at a first end by a perpendicular wall and secured to said cap interior at a second end and along said periphery;

a spring positioned between said base end and said perpendicular wall and around said push rod central portion;

wherein said front end of said push rod is pivotally connected to said ball trap member such that upon pressing said push button said spring is compressed and said push rod moves to an extended position to communicate with said ball trap member to release said golf ball, and upon release of said push button said spring urges said ball ejector assembly substantially simultaneously with said ball trap member to return to the set position.

3. A golf ball dispensing device for use in storing and dispensing golf balls as described in claim 1 wherein said ball trap member comprises:

a central portion having an aperture therethrough;

an outer portion having opposing handles each having a first end with an aperture therethrough and a second end, said apertures of said first ends aligned and contiguous with said central portion aperture and aligned with said support arm apertures for pivotally connecting said ball trap member to said support arms by positioning a pin therethrough;

an inner portion having opposing flanges each having a top end pivotally connected to said first end of said push rod; and a lower portion having downwardly extending opposing flanges pivotally connected to said lever for pivotally connecting said lever to said ball trap member.

4. A golf ball dispensing device for use in storing and dispensing golf balls as described in claim 1 wherein said spring biased piston comprises a coil spring, a piston having a top end for urging a golf ball upwardly and a lower end engaged with said spring, said spring is maintained between said piston lower end and said tubular member base for biasing said top end against a golf ball.

5. A golf ball dispensing device for use in storing and dispensing golf balls as described in claim 1 wherein said ball reloading assembly includes a longitudinal channel formed in the side of said tubular member, a stud fixedly secured to said piston and fitted to move in said longitudinal channel, said longitudinal channel having a bend at an end of said channel that is proximate said tubular member base, whereby one may compress said coil spring by urging said stud downwardly and into said bend to removably secure said stud.

6. A golf ball dispensing device for use in storing and dispensing golf balls as described in claim 5 wherein said ball reloading assembly enables pressing said push button of said ball ejector assembly to extend said push rod to pivot said ball trap member thus raising said handles from obstructing said nozzle opening to allow golf balls to be loaded into said nozzle opening and said tubular member.

7. A golf ball dispensing device for use in storing and dispensing golf balls as described in claim 1 wherein said upper portion includes at least one clip attached thereto for attaching the device to a golf bag.

8. A golf ball dispensing device for use in storing and dispensing of golf balls comprising:

a tubular member for storing a plurality of golf balls in a stacked configuration having an upper portion and a base at the bottom of said tubular member having an internal and external surface;

a cap, having a periphery, an interior surface and an exterior surface, is fixedly attached along said periphery to said upper portion of said tubular member, said cap having opposing support arms extending downwardly from said interior surface into said upper portion, said cap having an aperture therethrough;

a ball trap member for retaining the top golf ball of the plurality of stacked golf balls, said ball trap member housed within said cap and said upper portion and positioned between and pivotally connected at a pivot connection to said opposing support arms;

a ball ejector assembly secured to said cap interior and pivotally connected to said ball trap member, said ball ejector assembly movable from a set position wherein said ball trap member retains a golf ball, to an extended position wherein said ball trap member rotates about said pivot connection to release the golf ball;

a nozzle opening formed in said upper portion of said tubular member and positioned below a push button and substantially aligned with the golf ball retained by said ball trap member;

a lever pivotally connected to said ball trap member for urging the top golf ball through said nozzle opening substantially simultaneously when said ball trap member releases the top golf ball;

a spring biased piston for urging a stacked plurality of golf balls against said ball trap member such that the dispersed top golf ball is replaced; and a ball reloading assembly for loading a plurality of golf balls in said tubular member having a pull ring removably attached to said external surface of said base, a cord attached at one end to said pull ring and a bead attached to said cord.

9. A golf ball dispensing device for use in storing and dispensing golf balls as described in claim 8 wherein said spring biased piston means comprises a coil spring, a piston having a top end for urging a golf ball upwardly and a lower end for securing said spring, said spring is maintained between said piston lower end and said internal surface of said tubular member base for biasing said top end against a golf ball.

10. A golf ball dispensing device for use in storing and dispensing golf balls as described in claim 8 wherein said ball reloading assembly further includes the other end of said cord attached to said piston, said base having an aperture of a geometric configuration allowing said bead to pass therethrough and allowing a portion of said cord above said bead to be positioned therein such that said bead rests against said external surface when said cord is pulled to compress said spring biased piston means, said bead is positioned on said cord such that when said cord and bead are pulled through said base aperture said spring piston means are compressed.

11. A golf ball dispensing device for use in storing and dispensing golf balls as described in claim 8 wherein said ball reloading assembly includes pressing said push button of said ball ejector assembly extending said push rod to pivot said ball trap member thus raising said handles from obstructing said nozzle opening to allow golf balls to be loaded into said nozzle opening and said tubular member.

12. A golf ball dispensing device for use in storing and dispensing of golf balls comprising:

a tubular member for storing a plurality of golf balls in a stacked configuration having an upper portion and a base at the bottom of said tubular member;

a cap, having a periphery, an interior surface and an exterior surface, is fixedly attached along said periphery to said upper portion, said cap having opposing support arms extendingly downwardly from said interior into said upper portion, said cap having an aperture therethrough;

a ball trap member for retaining the top golf ball of the plurality of stacked golf balls having a central portion having an aperture therethrough, an outer portion having opposing handles each having a first end with an aperture therethrough and a second end, said apertures of said first ends aligned and contiguous with said central portion aperture and aligned with said support arm apertures for pivotally connecting said ball trap member to said support arms by positioning a pin therethrough, an inner portion having opposing flanges each having a top end with an aperture therethrough, a lower portion having downwardly extending opposing flanges with an aperture therethrough, said ball trap member housed within said cap and said upper portion and positioned between and pivotally connected to said opposing support arms;

a ball ejector assembly secured to said cap interior and pivotally connected to said ball trap member, said ball ejector assembly movable from a set position wherein said ball trap member retains a golf ball to an extended position wherein said ball trap member rotates about said pivot connection to release the golf ball;

a nozzle opening formed in said upper portion and positioned below a push button and substantially aligned with the golf ball retained by said ball trap member;

a lever pivotally connected to said lower portion of said ball trap member for urging the top golf ball through said nozzle opening substantially simultaneously when said ball trap member releases the top golf ball;

spring biased piston means for urging a stacked plurality of golf balls against said ball trap member such that the dispersed top golf ball is replaced;

a ball reloading assembly for loading a plurality of golf balls in said tubular member.

13. A golf ball dispensing device for use in storing and dispensing golf balls as described in claim 12 wherein said opposing handles extend from said first end to said second end so that upon a golf ball entering said ball trap member, said opposing handles retain said ball.

* * * * *